US011200833B2

(12) United States Patent
Ishiwata

(10) Patent No.: US 11,200,833 B2
(45) Date of Patent: Dec. 14, 2021

(54) IMAGE DISPLAY DEVICE AND IMAGE DISPLAY METHOD

(71) Applicant: NEC Display Solutions, Ltd., Tokyo (JP)

(72) Inventor: Akio Ishiwata, Tokyo (JP)

(73) Assignee: SHARP NEC DISPLAY SOLUTIONS, LTD., Tokyo (JP)

( * ) Notice: Subject to any disclaimer, the term of this patent is extended or adjusted under 35 U.S.C. 154(b) by 0 days.

(21) Appl. No.: 16/969,452

(22) PCT Filed: Feb. 21, 2018

(86) PCT No.: PCT/JP2018/006110
§ 371 (c)(1),
(2) Date: Aug. 12, 2020

(87) PCT Pub. No.: WO2019/163007
PCT Pub. Date: Aug. 29, 2019

(65) Prior Publication Data

US 2020/0372852 A1 Nov. 26, 2020

(51) Int. Cl.
*G09G 3/20* (2006.01)

(52) U.S. Cl.
CPC ..... *G09G 3/2096* (2013.01); *G09G 2360/04* (2013.01); *G09G 2370/045* (2013.01); *G09G 2370/12* (2013.01); *G09G 2370/20* (2013.01)

(58) Field of Classification Search
CPC .... G09G 3/2096; G09G 5/00; G09G 2370/20; G09G 2360/04; G09G 2370/12; G09G 2360/02; G09G 2370/045
See application file for complete search history.

(56) References Cited

U.S. PATENT DOCUMENTS

2014/0327685 A1* 11/2014 Lee ..... H04N 21/44209 345/520
2016/0004287 A1* 1/2016 Qiu ..... H01R 24/62 713/300

(Continued)

FOREIGN PATENT DOCUMENTS

JP 2009-055149 A 3/2009
JP 2013-120234 A 6/2013
JP 2017-167241 A 9/2017

OTHER PUBLICATIONS

User manual S*H85*, Samsung Electronics [online], Jan. 23, 2018, [retrieved on May 15, 2018], Internet: <URL:https://www.samsung.com/US/business/support/owners/product/sh-850-series-s27h850qfn/>, pp. 42-44.

(Continued)

*Primary Examiner* — Abbas I Abdulselam
(74) *Attorney, Agent, or Firm* — McGinn I.P. Law Group, PLLC.

(57) ABSTRACT

An image display device includes: a signal input unit to which a first signal or a second signal is supplied using a signal cable in accordance with prescribed setting information, the signal cable having a plurality of transmission lines of prescribed transmission characteristics; a transmission line control unit configured to change a destination to which a signal is supplied using the plurality of transmission lines, in accordance with a transmission line setting for setting at least a portion of the plurality of transmission lines as transmission lines which transmit the first signal; an image control unit configured to generate an image signal from the first signal supplied using the transmission lines in accordance with a transmission format setting for designating a format for transmitting the first signal using the transmission lines; and a setting control unit configured to change the transmission line setting and the transmission format setting.

14 Claims, 9 Drawing Sheets

(56) References Cited

U.S. PATENT DOCUMENTS

| | | | | |
|---|---|---|---|---|
| 2016/0171925 | A1 | 6/2016 | Hussain | |
| 2017/0308498 | A1 | 10/2017 | Chen | |
| 2018/0164983 | A1* | 6/2018 | Torii | G06F 3/012 |
| 2020/0012613 | A1* | 1/2020 | Frederick | G06F 13/385 |

OTHER PUBLICATIONS

VESA DisplayPort Alt Mode for USB Type-C standard feature summary, VESA [online], Sep. 22, 2014, [retrieved on May 15, 2018], Internet: <URL:https//www.vesa.org/wp-content/uploads/2014/09/DP-Alt-Mode-Overview-for-VESA-v1.pdf>, pp. 10, 11, 14.

PD Alternate Mode: DisplayPort, Texas Instruments [online], Feb. 27, 2017, [retrieved on May 15, 2018], Internet: <URL:http://www.ti.com/analog/docs/litabsmultiplefilelist.tsp?literatureNumber=slva844a&docCategoryId=361>, p. 5.

International Search Report (ISR) (PCT Form PCT/ISA/210), in PCT/JP2018/006110, dated May 29, 2018.

* cited by examiner

IMAGE DISPLAY DEVICE AND IMAGE DISPLAY METHOD

TECHNICAL FIELD

The present invention relates to an image display device, such as a display and a projector for displaying images, and to an image display method.

BACKGROUND ART

Current computer platform architecture designs include a number of different interfaces for connecting a single device to other devices. These interfaces provide I/O (input/output) for computing devices and peripheral devices, and can use various protocols and standards that provide I/O.

For example, current computer systems include a universal serial bus (USB) subsystem serving as a supported connection interface, as realized by means of connectors on cables connecting those devices.

With regards to the USB standards, USB 2 and USB 3 are standards of general I/O interfaces used for transmitting and receiving data between computer systems.

For example, USB Type-C includes: eight (four sets of two) differential signal lines (RX1, TX1, RX2, and TX2) for high-speed signal transmission supporting the USB 3.1 standard; a set of two differential signal lines (D) supporting the USB 2.0 standard; control signal lines (CC1, CC2, SBU1, and SBU2) used for configuration when transmitting and/or receiving data between connected devices; and each of VBUS and GND lines for supplying electric power to a connection device connected to a computer.

For example, a USB Type-C cable includes lines (wires) for supplying the respective signals mentioned above and electric power, and for connecting GND.

A method of transmitting signals of DisplayPort, which is a digital interface standard for transmitting, for example, HD (High Definition) images and HD audio using a part or all of the above-mentioned four sets of high speed signal transmission differential signal lines (RX1, TX1, RX2, and TX2), has been standardized as the DisplayPort Alt Mode on USB Type-C.

For example, the setting of transmission lines through which various signals including image signals and control signals are transmitted (transmission line setting) is set as Pin Assignment C or Pin Assignment D. The Pin Assignment C setting is a setting in which all of the above-mentioned four sets of differential signal lines (RX1, TX1, RX2, and TX2) are used as DisplayPort. The Pin Assignment D setting is a setting in which predetermined two sets among the above-mentioned four sets of differential signal lines (RX1, TX1, RX2, and TX2) are used as DisplayPort and the remaining two sets are used as USB 3.1.

Moreover, two types of transmission modes have been standardized for DisplayPort, namely, the single stream transport (SST) mode which is an image transmission mode (an image transmission format) for outputting a single image, and the multi-stream transport (MST) mode which is an image transmission mode for outputting two or more images.

For example, in the case where an image transmission device and an image display device are connected using a USB Type-C cable, and two or more image display devices are daisy-chain connected (cascade connected) using a DisplayPort cable to the subsequent stage of the image display device connected to the image transmission device, a single image is transmitted when the single stream transport is set as the image transmission mode. Therefore each image display device can display the same image. On the other hand, several images are transmitted when the multi-stream transport is set as the image transmission mode, and as a result, the image display devices can respectively display different images, for example. Moreover, when the multi-stream transport is set, for example, each one of the image display devices can display several different images.

Here, the DisplayPort cable is a cable set to transmit DisplayPort signals, and includes, for example, respective lines which support the DisplayPort standard. Also, the DisplayPort signals are signals including image signals which support the DisplayPort standard.

There are image display devices which have a USB Type-C input terminal, and support image input by DisplayPort Alt Mode on USB Type-C. (For example, Patent Document 1)

When an image transmission device and an image display device supporting DisplayPort Alt Mode on USB Type-C are connected using a USB Type-C cable, a DisplayPort signal and a USB 3.1 signal can be transmitted simultaneously by setting the transmission line setting to Pin Assignment D.

In the Pin Assignment D setting, two sets of differential signal lines are used as DisplayPort, and when the transmission speed is HBR2, the transmission speed of each set of differential signals is 5.4 Gbps. Therefore the transmission speed in this setting is 10.8 Gbps (5.4 Gbps×2).

HBR2 is one of the transmission speeds specified for transmitting signals using DisplayPort, and other transmission speeds include RBR (transmission speed: 1.62 Gbps), HBR (transmission speed: 2.7 Gbps), HBR2 (transmission speed: 5.4 Gbps), and HBR3 (transmission speed: 8.1 Gbps).

The transmission speed supported by the image display device used here is up to HBR2, and HBR3 is not supported (specification of the image display device).

Here, an image supplied by the image transmission device is, for example, a first image. The first image has a horizontal image resolution of 2,560 dots and vertical image resolution of 1,440 dots (resolution: 2,560×1,440), where the image refresh rate is 60 Hz and the image is represented using the 10-bit image gradation. When transmitting the first image using DisplayPort, the required transmission speed for a DisplayPort signal is approximately 9 Gbps (hereunder, "approximately" will be omitted).

That is to say, when the transmission line setting is set to Pin Assignment D, an image display device generally has the image transmission format thereof set to the single stream mode, so that the first image is received correctly (so that the specification of the image display device is met).

In such a case, the image display device receives a single image signal and thus displays a single image. Moreover, in such a case, the image display device can display the received image on a dot-by-dot basis. Note that the resolution of the display surface of the image display device such as a liquid crystal panel is 2,560 dots×1,440 dots. Here, displaying on the dot-by-dot basis (on the dot-by-dot display basis) is one of the display modes when displaying an image or the like on the display surface of an image display device in which one constituent pixel of the image supplied from the image transmission device or the like is displayed so as to correspond to one constituent pixel of the display surface of the image display device. That is to say, the supplied image is directly displayed without being subjected to any resolution conversion processing such as enlargement and reduction.

Next, described is an operation at a time of connecting the image transmission device and the image display device mentioned above, using a USB Type-C cable. When both of the image transmission device and the image display device are powered on after connecting both of the devices using the USB Type-C cable, the image transmission device acquires display information related to the image display device which is included (stored) in the image display device. This display information includes at least information on a transmission line setting and information on an image transmission format setting. Based on the acquired display information, the image transmission device supplies an image to the image display device using the USB Type-C cable according to the transmission line setting and the transmission format setting set (stored) in the image display device. Based on the transmission line setting information and the transmission format setting information stored in the memory storage unit, the image display device receives information such as an image from the image transmission device.

In the case where the display information set in the image display device sets the transmission line setting to Pin Assignment D and the image transmission format setting to SST, the operation mentioned above is performed, and the image transmission device and the image display device perform processing where the transmission line setting is Pin Assignment D and the image transmission format setting is SST.

CITATION LIST

Patent Literature

[Patent Document 1] Japanese Unexamined Patent Application, First Publication No. 2017-167241

SUMMARY OF THE INVENTION

Problems to be Solved by the Invention

Next, as described above, there is the state where the image transmission device and the image display device (serving as one image display device or a first image display device) are connected using a USB Type-C cable and an image is being displayed. Then considered is the case which has changed from the above state, where another image display device (serving as another image display device or a second image display device) is daisy-chain connected to the first image display device using a DisplayPort cable to display a different image on each of the first image display device and the second image display device. That is to say, a terminal of the first image display device (a DisplayPort Out terminal) which outputs DisplayPort signals and a terminal of the second image display device which supplies DisplayPort signals are connected using the DisplayPort cable.

Note that the state of each device may be in the state of each being powered on after the image transmission device, the first image display device, and the second image display device have been connected respectively. Also in this case, since the transmission line setting is set to Pin Assignment D and the transmission format setting is set to single stream (SST), each of the image display devices is performing display in a similar state. Also, the second image display device may be in the state of displaying the same image as that of the first image display device.

In this state, when the second display device displays an image different from that on the first image display device, it is necessary to perform setting again so as to supply two different images from the image transmission device.

That is to say, the user needs to manually change the image transmission format setting set in the first image display device from single stream (SST) to multi-stream (MST). Furthermore, when the image transmission format setting is "MST", two images are transmitted, for example, and therefore, the DisplayPort signal transmission speed needs to be 18 Gbps (9 Gbps×2) or higher. However, since the transmission line setting is set to Pin Assignment D, image signals (image information) cannot be properly transmitted only by setting the transmission format setting to "MST". In such a case, for example, the second image display device cannot display the image properly. That is to say, in this case, the user needs to manually change the transmission line setting of the first image display device from Pin Assignment D to Pin Assignment C.

That is to say, switching (changing) the transmission line setting is a setting of USB Type-C, while switching (changing) the transmission format is a setting of DisplayPort. Therefore, it is necessary for the user to individually change the transmission line setting and the transmission format setting, requiring the user to follow a complex procedure.

The present invention takes the above circumstances into consideration, with an object of providing an image display device and an image display method capable of enabling easy operation related to the process of transmission line setting and transmission format setting in the image display device, while reducing a burden on a user, by setting either one of transmission line setting and transmission format setting to change the setting of the other, without the user having to change the transmission line setting and the transmission format setting individually.

Means for Solving the Problem

The present invention is an image display device includes: a signal input unit to which a first signal or a second signal is supplied using a signal cable having a plurality of transmission lines of prescribed transmission characteristics; a transmission line control unit configured to change a destination to which a signal is supplied using the plurality of transmission lines, in accordance with a transmission line setting for setting at least a portion of the plurality of transmission lines as transmission lines which transmit the first signal; an image control unit configured to generate an image signal from the first signal supplied using the transmission lines in accordance with a transmission format setting for designating a format for transmitting the first signal using the transmission lines; and a setting control unit configured to change the transmission line setting and the transmission format setting in accordance with a change in prescribed setting information.

The present invention is an image display method includes: a signal input step for supplying a first signal or a second signal to a signal input unit, using a signal cable having a plurality of transmission lines of prescribed transmission characteristics; a transmission line control step for making a transmission line control unit change a destination to which a signal is supplied using the plurality of transmission lines, in accordance with a transmission line setting for setting at least a portion of the plurality of transmission lines as transmission lines which transmit the first signal; an image control step for making an image control unit generate an image signal from the first signal supplied using the transmission lines, in accordance with a transmission format setting for designating a format for transmitting the first signal using the transmission lines; and a setting control step for making a setting control unit change the transmission line setting and the transmission format setting, in accordance with a change in prescribed setting information.

Advantageous Effects of Invention

According to the present invention, it is possible to provide an image display device and an image display method capable of enabling easy operation related to the process of transmission line setting and transmission format setting, while reducing a burden on a user, by setting either one of transmission line setting and transmission format setting to change the setting of the other, without the user having to change the transmission line setting and the transmission format setting individually.

DESCRIPTION OF EMBODIMENTS

The image display device of the present invention is a device which supports image input using a signal cable and to which at least a first signal including an image signal for indicating an image is supplied using, in particular, a signal cable having a plurality of transmission lines (transmission paths) of prescribed transmission characteristics. The first signal may be a signal (a DisplayPort signal) which supports the DisplayPort standard, which is a first standard. The prescribed transmission characteristics are for example the same transmission characteristics (such as transmission speed and frequency characteristic). Note that the same transmission characteristics include those designed to have the same transmission characteristics, and are not required to have exactly the same characteristics. Moreover, the first signal may include a timing signal related to an image (such as a synchronization signal and a signal indicating an image effective period: DE signal), and the like.

Furthermore, the image display device of the present invention is a device capable of performing setting related to transmission of the first signal or the second signal supplied from the image transmission device. Examples of the setting related to transmission of the first signal include the transmission format setting and the transmission line setting of the first signal.

Moreover, the image display device of the present invention may be an image display device which transmits an image to one or more other image display devices connected thereto in a daisy chain fashion using an image output terminal.

The signal cable mentioned above may be a cable which supports a prescribed standard. For example, the prescribed standard is DisplayPort Alt Mode on USB Type-C.

Several settings related to image transmission may respectively support several different standards. Examples of the several standards include a standard related to DisplayPort and a standard related to USB.

In the image display device of the present invention, for example, the several settings respectively set in the several standards can be set in a cooperative manner by performing a prescribed operation. For example, setting of a transmission line supporting the USB standard can be set in the cooperative manner by setting a transmission format supporting the DisplayPort standard. As a result, an optimum image transmission between the image transmission device and the image display device can be set without causing the user to perform a complex operation.

First Exemplary Embodiment

Figure 1:
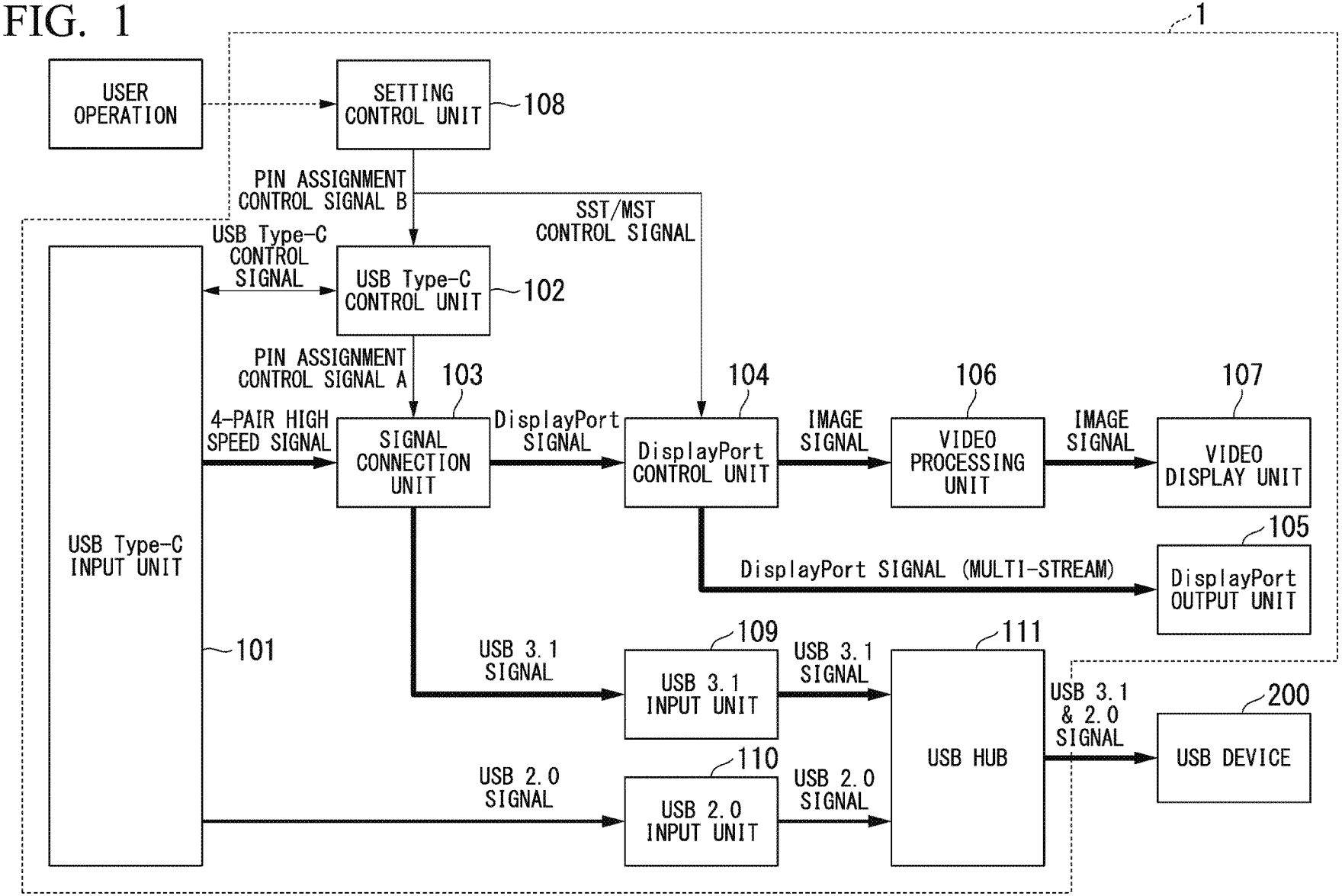
FIG. 1 is a diagram showing a configuration example of an image display device according to a first exemplary embodiment of the present invention.

Hereunder, an image display device according to a first exemplary embodiment of the present invention will be described, with reference to the drawings. FIG. 1 is a diagram showing a configuration example of an image display device according to the first exemplary embodiment of the present invention.

As shown in FIG. 1, an image display device 1 includes each of a USB Type-C input unit 101, a USB Type-C control unit 102, a signal connection unit 103, a DisplayPort control unit 104, a DisplayPort output unit 105, a video processing unit 106, a video display unit 107, a setting control unit 108, a USB 3.1 input unit 109, a USB 2.0 input unit 110, and a USB hub 111.

The USB Type-C input unit 101 includes a USB Type-C connector.

That is to say, a first signal or a second signal is supplied (input) to the USB Type-C input unit 101 using a signal cable, such as a USB Type-C cable, having a plurality of transmission lines of prescribed transmission characteristics. The first signal and the second signal are supplied in the case of bidirectional communication (information transmission). Also, in this case, the signals are supplied in one direction, for example. The USB Type-C input unit 101 is an example of a signal input unit.

The first signal includes at least an image signal which indicates an image. Moreover, the first signal may include a timing signal related to an image (such as a synchronization signal and a signal indicating an image effective period: DE signal) and a control signal or the like. For example, in the present exemplary embodiment, the first signal is a signal which supports a first standard. The first standard is the DisplayPort standard. The second signal is a signal which supports a second standard. The second standard is the USB standard. The second signal is a USB signal which supports the USB standard.

The USB Type-C control unit 102 has a memory storage unit (not shown in the drawings), and stores various USB Type-C settings (including connection settings) and at least a transmission line setting for the first signal. Moreover, the USB Type-C control unit 102 manages various USB Type-C settings, and outputs a control signal (a Pin Assignment control signal A) for setting a transmission line, to the signal connection unit 103 according to the transmission line setting. For example, the transmission line setting is set to Pin Assignment D (first transmission line setting) or Pin Assignment C (second transmission line setting). The Pin Assignment control signal A is a control signal which instructs the signal connection unit 103 to set the transmission line to correspond to Pin Assignment D or Pin Assignment C.

The transmission line setting may be a setting which includes the number of transmission lines for transmitting the first signal or the number of transmission lines for transmitting signals other than the first signal, among the plurality of transmission lines. In such a case, the transmission lines for transmitting the first signal, which correspond to the number of set transmission lines, are preliminarily stored in association with each other.

Moreover, the USB Type-C control unit 102 outputs a Pin Assignment control signal A to the signal connection unit 103 according to the change in the transmission line setting. For example, upon receiving from the setting control unit 108 described later, a signal (a Pin Assignment control signal B) which corresponds to a change in the transmission line setting, the USB Type-C control unit 102 outputs the Pin Assignment control signal A corresponding to a Pin Assignment control signal B, to the signal connection unit 103.

Note that the first transmission line setting and the second transmission line setting are settings which differ in part from each other. That is to say, the first transmission line setting and the second transmission line setting are settings in which at least some of the set transmission lines transmit different types of signals. For example, a signal including an image signal (a packet) and a signal not including an image signal (a packet) are different types of signals. Moreover, signals supporting different standards, such as a signal (a packet) supporting DisplayPort and a signal (a packet) supporting USB, are different types of signals. Note that these signals are not limited to packets.

The USB Type-C control unit 102 is an example of a connection control unit.

The signal connection unit 103 receives a Pin Assignment control signal A (a first control signal for setting transmission lines) from the USB Type-C control unit 102, and based on the Pin Assignment control signal A, sets the destination of signals (high speed signals) supplied using the four sets of differential signal lines (RX1, TX1, RX2, and TX2) (hereunder, may be referred to as transmission lines) of a USB Type-C cable (a signal cable). At this time, in the case where the Pin Assignment control signal A indicates a setting corresponding to Pin Assignment D, the signal connection unit 103 supplies a DisplayPort signal (a first signal) transmitted using two out of the four preliminarily determined sets of differential signals, to the DisplayPort control unit 104 described later, and supplies a USB signal (a second signal) transmitted using the remaining two sets of transmission lines, to the USB 3.1 input unit 109. That is to say, the setting of Pin Assignment D, for example, sets the four sets of differential signal lines, as follows: RX2 being DisplayPort Lane 0; TX2 being DisplayPort Lane 1; TX1 being USB 3.1 SSTX1; and RX1 being USB 3.1 SSRX1.

Moreover, in the case where the Pin Assignment control signal A indicates a setting corresponding to Pin Assignment C, the signal connection unit 103 supplies a DisplayPort signal transmitted using all of the four preliminarily determined sets of differential signals, to the DisplayPort control unit 104.

That is to say, the setting of Pin Assignment D, for example, sets the four sets of differential signal lines, as follows: RX2 being DisplayPort Lane 0; TX2 being DisplayPort Lane 1; TX1 being DisplayPort Lane 2; and RX1 being DisplayPort Lane 3.

The transmission line control unit includes the USB Type-C control unit (the connection control unit) 102 and the signal connection unit 103. That is to say, the transmission line control unit changes the destination to which a signal (a first signal or a second signal) is supplied using the plurality of transmission lines, in accordance with the transmission line setting for setting at least a portion of the plurality of transmission lines as transmission lines which transmit the first signal.

The DisplayPort control unit 104 has a memory storage unit (not shown in the drawings), and stores at least a setting for transmission format (transmission format setting) of an image (an image signal). Moreover, the DisplayPort control unit 104 has a memory storage unit (not shown in the drawings), and stores an EDID of itself. The transmission format setting and the EDID may be stored in the same memory storage unit or may be stored in different memory storage units. The DisplayPort control unit 104 has a function of outputting an input DisplayPort signal (multi-stream) to the video processing unit 106 and a function of outputting it to the DisplayPort control unit 105. It is preferable that the signal output to the video processing unit 106 is converted into an image signal (an RGB signal) corresponding to colors (three primary colors) such as red (R), green (G), and blue (B) used in the video processing unit 106 to be output, and that the signal output to the DisplayPort output unit 105 is output as an "SST" or "MST" DisplayPort signal. The colors which support the image signal used in the video processing unit 106 are at least the basic colors (for example, the three primary colors) of light emitted when the image display unit 107 displays an image. The image signal used in the video processing unit 106 may be a brightness signal, a color difference signal, or the like.

Moreover the DisplayPort control unit 104 generates an image signal from the first signal transmitted using the transmission lines in accordance with the transmission format setting. For example, when the transmission format setting is SST the supplied image is a single image. Therefore the DisplayPort control unit 104 converts the supplied image into (generates) an image signal to be used in the video processing unit 106 and outputs the converted image signal to the video processing unit 106. The DisplayPort control unit 104 may supply the supplied image to the DisplayPort output unit 105. Moreover, when the transmission format setting is MST the supplied image is a plurality of images. Therefore the DisplayPort control unit 104 converts one prescribed image among the supplied images into (generates) an image signal to be used in the video processing unit 106 and outputs the converted image signal to the video processing unit 106. The DisplayPort control unit 104 may supply another image among the supplied images (an image different from the image to be output to the video processing unit 106, that is to say, an image different from the image to be displayed on the image display unit 107) to the DisplayPort output unit 105. Note that the image to be output to the video processing unit 106 (the image signal) (that is, the image to be displayed on the image display unit 107) may be plural. Furthermore, the images supplied to the DisplayPort output unit 105 may include either one or both of the same images as the image output to the video processing unit 106, or an image different from the image output to the video processing unit 106. Moreover, the image supplied to the DisplayPort output unit 105 may be one or plural. Also, the image supplied to the DisplayPort output unit 105 may be an image selected by the user.

Furthermore, the DisplayPort control unit 104 changes the processing described above according to a change made in the transmission format setting. For example, upon receiving a signal (an SST/MST control signal) from the setting control unit 108 described later which corresponds to the change in the transmission line setting, processing corresponding to the SST/MST control signal is performed.

Moreover, the DisplayPort control unit 104 has a function of obtaining information such as image transmission speed required for performing correct display on the second another image display device on the subsequent stage connected to the DisplayPort output unit 105, or an image display device daisy-chain connected further to the second image display device, by acquiring data such as for example EDID (Extended Display Identification Data) and DPCD (DisplayPort setting Data) on the subsequent stage which are transmitted through an AUX (Auxiliary) channel. That is to say, the image transmission speed of the DisplayPort signal is obtained based on resolution information of the displayed image included in the EDID and transmission speed information included in the DPCD on the subsequent stage. Note that other data may be used as long as the information for performing correct display on the image display device connected on the subsequent stage is obtained.

The DisplayPort control unit 104 is an example of an image control unit.

The DisplayPort output unit 105 includes a DisplayPort-Out terminal (connector) for outputting DisplayPort signals which support the DisplayPort standard. The DisplayPort-Out terminal is connected to the image display device on the subsequent stage (the second image display device) using a DisplayPort cable. The DisplayPort-Out terminal is an example of an image output terminal. The DisplayPort output unit 105 is an example of an image output unit. The image output unit may output not only DisplayPort signals but also image signals of other signal formats such as RGB signals and brightness/color difference signals.

The video processing unit 106 converts the image signal supplied from the DisplayPort control unit 104 into an image signal (also referred to as a video signal) to be displayed on the video display unit 107, and outputs the image signal to the video display unit 107. The video processing unit 106 performs, for example, color correction processing, contour correction processing, resolution conversion processing, gamma correction processing, and so forth as required, to convert the video signal.

The video display unit 107 includes a liquid crystal panel, for example, and has a function of receiving an input of the image signal output from the video processing unit 106 and displaying it as an image (video) to the user.

The USB 3.1 input unit 109 has a function of outputting a USB 3.1 signal output from the signal connection unit 103 to the USB hub 111.

The USB 2.0 input unit 110 has a function of outputting a USB 2.0 signal output from the USB Type-C input unit 101 to the USB hub 111.

The USB hub 111 has a function of receiving input of a USB 3.1 signal output from the USB 3.1 input unit 109 and a USB 2.0 signal output from the USB 2.0 input unit 110 respectively, and outputting to each USB device 200; and receives input of a USB 3.1 signal and a USB 2.0 signal supplied from the USB device 200, respectively, and outputs to a prescribed function unit (not shown in the drawings).

The USB hub 111 is an example of a USB connection unit.

The setting control unit 108 may be configured as a part of an image display device control unit in a function block which controls the entire image display device 1. The setting control unit 108 handles user control from an external device such as a key operation on a keyboard or an operation on a remote control terminal (a remote controller), or user control using a button included in the image display device 1, and can change setting values of the image display device 1 (such as the resolution of an image to be displayed, the transmission line setting described later, and the transmission format setting). Moreover, the setting control unit 108 has a function of changing the transmission line setting stored in the USB Type-C control unit 102. Upon the transmission line setting having been changed, the setting control unit 108 outputs a signal (a Pin Assignment control signal B) which corresponds to the change in the transmission line setting, to the USB Type-C control unit 102. The setting control unit 108 has a function of changing the transmission format setting stored in the DisplayPort control unit 104. Upon the transmission format setting having been changed, the setting control unit 108 outputs a signal (an SST/MST control signal) which corresponds to the change in the transmission format setting, to the DisplayPort control unit 104.

The USB device 200 represents a general USB device such as a mouse, a keyboard, and a USB memory. The USB device 200 is an external device connected to the image display device 1 as a USB device.

Figure 2:
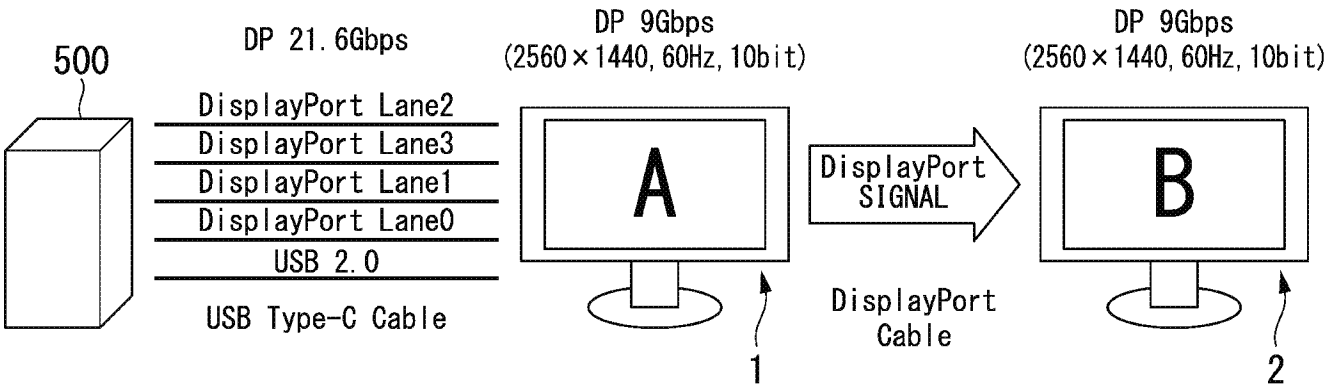
FIG. 2 is a diagram showing a configuration example in which another image display device 2 is daisy-chain connected to an image display device 1 in order to establish a multi-display configuration.

FIG. 2 is a diagram showing a configuration example of a multi-display configuration in which a plurality of (for example two) image display devices are connected to display images. An image transmission device 500 and the image display device 1 (serving as one image display device or a first image display device) are connected using a USB Type-C cable. Moreover, the image display device 1 and an image display device 2 (serving as another image display device or a second image display device) are daisy-chain connected using a DisplayPort cable.

Note that, the image display device 1 has the initial setting such that the transmission format setting of the DisplayPort signal (first signal) is set to single stream and the transmission line setting is set to Pin Assignment D.

In this state, upon powering on all of the devices 1, 2, and 500, the image transmission device 500 acquires display information related to the image display device 1 included (stored) in the image display device 1. This display information includes at least information on the transmission line setting for transmitting the first signal, and information on the image transmission format setting for transmitting the first signal.

Specifically, the image transmission device 500 uses USB Type-C control signal lines (CC1, CC2) to acquire a transmission line setting from the memory storage unit included in the USB Type-C control unit 102. Moreover, the image transmission device 500 uses USB Type-C control signal lines (SBU1, SBU2) to acquire a transmission format setting from the memory storage unit included in the DisplayPort control unit 104 via the USB Type-C control unit 102 and the signal connection unit 103. Moreover, the image transmission device 500 uses USB Type-C control signal lines (SBU1, SBU2) to acquire an EDID from the memory storage unit included in the DisplayPort control unit 104 via the USB Type-C control unit 102 and the signal connection unit 103.

Based on the acquired display information, the image transmission device 500 supplies a first signal to the image display device 1 using a USB Type-C cable according to (so as to match) the transmission line setting and the transmission format setting set in the image display device 1. Based on the transmission line setting information and the transmission format setting information stored in the memory storage unit, the image display device 1 receives the first signal from the image transmission device 500 and displays the image included in the first signal.

The image transmission device acquiring display information set (stored) in the image display device; and performing setting of communication (information transmission) between the image display device and the image transmission device based on the display information, are hereunder referred to as configuration. Note that display information acquisition performed by the image display device may mean the image transmission device acquiring the display information from the image display device regardless of the subject of the action, that is to say, regardless of whether the image transmission device reads display information from the image display device or the image display device transmits display information to the image transmission device.

Moreover, the configuration may include performing other initial settings such as acquisition of information such as an EDID. Also, the display information may include information such as an EDID.

Furthermore, the image display device 1 may supply the set image among the received images to the image display device 2 based on the transmission format information. The image display device 2 displays the image supplied from the image display device 1.

Specifically, upon determining on the basis of the acquired display information, the transmission format as being single stream and the transmission line setting as being Pin Assignment D, the image transmission device 500 sets itself to "SST" as the transmission format and Pin Assignment D as the transmission line setting, and supplies the first signal to the image display device 1. The image display device 1 receives the first signal from the image transmission device 500 according to the setting of itself in which the transmission format is "SST" and the transmission line setting is Pin Assignment D, and displays the image included in the received first signal.

Moreover, the image display device 1 supplies the received image (the same image as that being displayed by itself since "SST" is set (since the received image is a single image)) to the image display device 2. In such a case, the image transmission device 500 and the image display device 1 can use USB 3.1 because the transmission line is set to Pin Assignment D.

Then, in the case of changing from the state where the image display device 1 and the image display device 2 are displaying the same image to the state where the image display device 1 and the image display device 2 are displaying different images, the user switches (changes) the transmission format setting from "SST" to "MST". This changing of the transmission format setting is performed by an operation using a control button included in the image display device or a remote controller or the like of an external device.

Upon the user having changed the transmission format setting, the setting control unit 108 detects the transmission format setting as having been changed, and the setting control unit 108 outputs a signal (an SST/MST control signal) which corresponds to the change in the transmission format setting, to the DisplayPort control unit 104. In such a case, the signal corresponding to the change in the transmission format setting is a signal indicating that the single stream setting is changed to the multi stream setting. Moreover, the setting control unit 108 outputs a signal (a Pin Assignment control signal B) which corresponds to the change in the transmission line setting, to the transmission line control unit (USB Type-C control unit 102). In such a case, the signal corresponding to the change in the transmission line setting is a signal indicating that the setting corresponding to Pin Assignment D is changed to the setting corresponding to Pin Assignment C. The DisplayPort control unit 104 changes the transmission format setting stored in the memory storage unit from the single stream setting to the multi-stream setting according to the received signal. The transmission line control unit (the USB Type-C control unit 102) changes the transmission line setting stored in the memory storage unit from the setting corresponding to Pin Assignment D to the setting corresponding to Pin Assignment C, according to the received signal.

Then, the setting control unit 108 transmits a command (an instruction) to the image transmission device 500 to perform configuration, and the setting control unit 108 controls the image display device 1 to perform configuration.

Note that this configuration is performed, in addition to when electric power is supplied to the image transmission device or the image display device, by means of a control command which is transmitted from the image display device using such as the control signal lines (CC1, CC2) of a USB Type-C cable. That is to say, the configuration is commenced by transmitting a signal from the image display device to the image transmission device, the signal being a command indicating that the transmission line setting has been changed or a command indicating that the DisplayPort Hot-Plug signal has changed (such as having changed from a low level to a high level), or a command indicating that the configuration is starting. That is to say, the configuration is commenced by directly or indirectly transmitting the command for prompting configuration, from the image display device to the image transmission device. Note that configuration may be commenced not only by means of a control command transmission but also by notifying the image transmission device by providing a dedicated terminal and line and changing the voltage level of the terminal (for example, by changing it from a low level to a high level).

Conventional image display devices required the user to perform a complex procedure, that is to say, it was necessary to re-perform configuration including, for example, powering each device off and then powering it back on again or disconnecting the USB Type-C cable between the image display device and the image transmission device and then re-connecting the USB Type-C cable, in order to apply the setting change of the image display device to the image transmission device.

However, by performing the control as described above, the settings of the image display device 1 and the image transmission device 500 can be easily changed and the burden on the user can be reduced.

Moreover, while the user was able to manually set the image display device and the image transmission device respectively, it was still necessary for the user to perform the complex procedure.

Configuration after changing setting does not necessarily have to be performed, and the setting may be reflected from the moment of powering on the device the next time. In such a case, it is desirable that the image display device 1 and the image transmission device 500 operate with the setting before change until the electric power to the image display device is turned off after the setting is changed.

Figure 3:
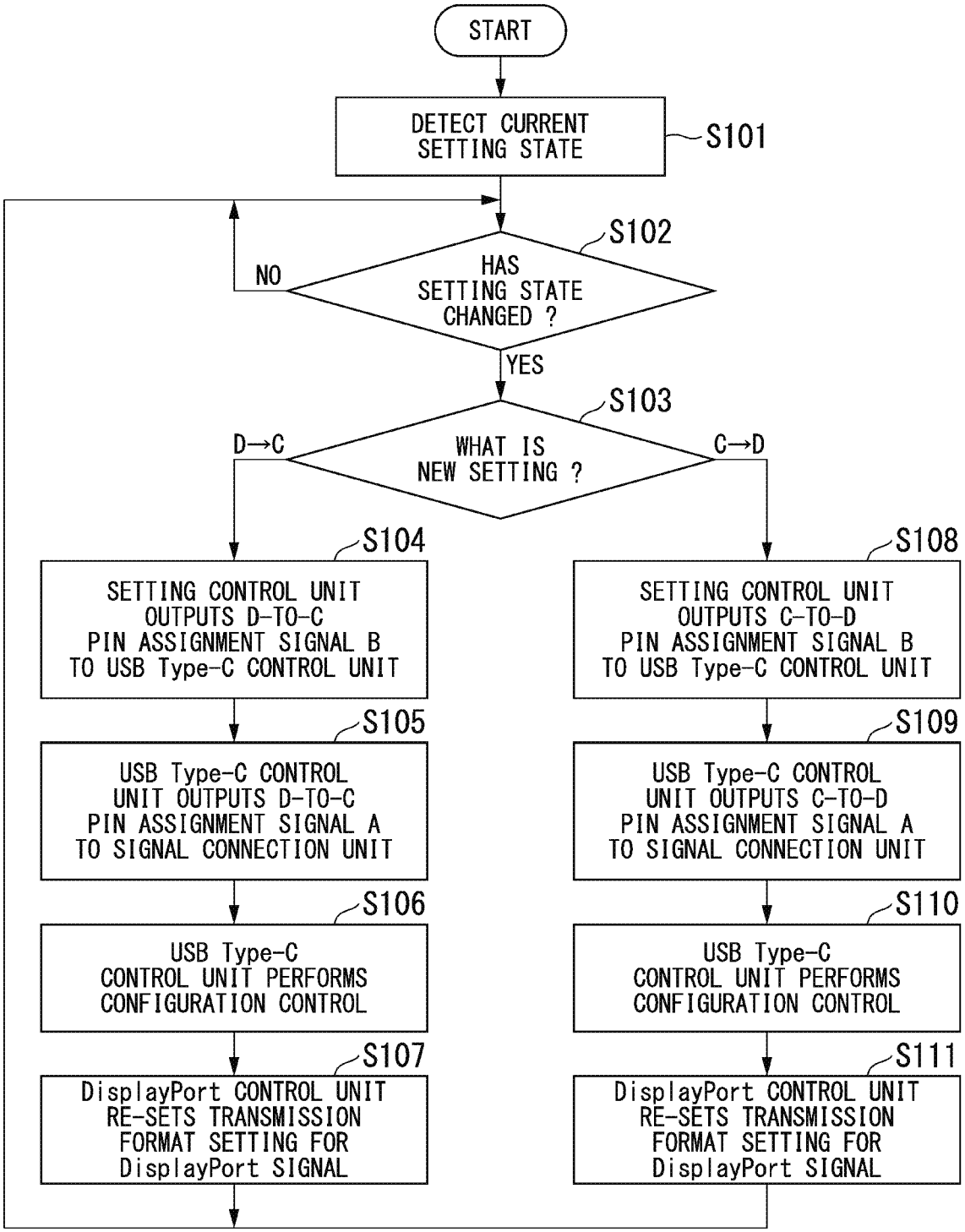
FIG. 3 is a flowchart showing an operation example showing control of transmission line setting and transmission format setting in the image display device 1 according to the first exemplary embodiment of the present invention.

FIG. 3 is a flowchart showing an operation example showing control of transmission line setting and transmission format setting in the image display device 1 according to the first exemplary embodiment of the present invention.

Step S101: The setting control unit 108 detects the current transmission line setting and transmission format setting, and writes and stores them in the memory storage unit therein.

Step S102: The setting control unit 108 determines whether or not the setting state of the transmission format setting has been changed by the user, from an external device (such as a remote controller). At this time, if the setting state of the transmission format setting has been changed, the setting control unit 108 advances the process to Step S103. On the other hand, if the setting state of the transmission format setting has not been changed, the setting control unit 108 repeats the process of Step S102.

Step S103: If the transmission format setting has been changed from "SST" to "MST", the setting control unit 108 advances the process to Step S104. On the other hand, if the transmission format setting has been changed from "MST" to "SST", the setting control unit 108 advances the process to Step S108.

Step S104: If the transmission format setting has been changed from "SST" to "MST", the setting control unit 108 outputs a Pin Assignment control signal B, which indicates that the transmission line setting changes from Pin Assignment D to Pin Assignment C, to the USB Type-C control unit 102.

Moreover, the setting control unit 108 outputs an SST/MST control signal, which indicates that the transmission format setting changes from "SST" to "MST", to the DisplayPort control unit 104.

Step S105: The USB Type-C control unit 102 outputs a Pin Assignment control signal A, which indicates that the transmission line setting changes from Pin Assignment D to Pin Assignment C, to the signal connection unit 103.

In the case where the Pin Assignment control signal A indicates a setting corresponding to Pin Assignment C, the signal connection unit 103 supplies, to the DisplayPort control unit 104, a DisplayPort signal output from the USB Type-C input unit 101 and transmitted using all of the four sets of transmission lines.

Step S106: The USB Type-C control unit 102 changes the transmission line setting stored in the memory storage unit from the setting corresponding to Pin Assignment D to the setting corresponding to Pin Assignment C, according to the Pin Assignment control signal A. Then, the USB Type-C control unit 102 transmits a command to the image transmission device 500 to perform configuration, and controls the image display device 1 to perform configuration.

Step S107: If the SST/MST control signal indicating that the transmission format setting changes from single stream to multi-stream is supplied, the DisplayPort control unit 104 sets the transmission format setting of the DisplayPort signal again. That is to say, the DisplayPort control unit 104 is in the setting of outputting an image signal generated from the DisplayPort signal to the video processing unit 106, and outputting another image signal generated from the DisplayPort signal as a DisplayPort signal to the image display device 2 on the subsequent stage daisy-chain connected via the DisplayPort output unit 105.

Step S108: If the transmission format setting has been changed from "MST" to "SST", the setting control unit 108 outputs a Pin Assignment control signal B, which indicates that the transmission line setting changes from Pin Assignment C to Pin Assignment D, to the USB Type-C control unit 102.

Moreover, the setting control unit 108 outputs an SST/MST control signal indicating that the transmission format setting changes from multi-stream to single stream, to the DisplayPort control unit 104.

Step S109: The USB Type-C control unit 102 outputs a Pin Assignment control signal A, which indicates that the transmission line setting changes from Pin Assignment C to Pin Assignment D, to the signal connection unit 103.

In the case where the Pin Assignment control signal A indicates the setting which corresponds to Pin Assignment D, the signal connection unit 103 supplies a DisplayPort signal output from the USB Type-C input unit 101 and transmitted using two out of the four sets of transmission lines to the DisplayPort control unit 104, and supplies a USB signal transmitted using the remaining two sets of transmission lines to the USB 3.1 input unit 109.

Step S110: The USB Type-C control unit 102 changes the transmission line setting stored in the memory storage unit from the setting corresponding to Pin Assignment C to the setting corresponding to Pin Assignment D, according to the Pin Assignment control signal A. Then, the USB Type-C control unit 102 transmits a command to the image transmission device 500 to perform configuration, and controls the image display device 1 to perform configuration.

Step S111: If an SST/MST control signal indicating that the transmission format setting changes from "MST" to "SST" is supplied, the DisplayPort control unit 104 again sets the transmission format setting of the DisplayPort signal stored in the memory storage unit from "MST" to "SST". Moreover, the DisplayPort control unit 104 is set to output the image signal generated from the DisplayPort signal to the video processing unit 106. Also, the DisplayPort control unit 104 may output the same image signal as that generated from the DisplayPort signal mentioned above as a DisplayPort signal, to the image display device 2 daisy-chain connected on the subsequent stage via the DisplayPort output unit 105.

In the first exemplary embodiment, with the configuration described above, when the user uses two display screens of the image display devices 1 and 2 as a multi-display configuration, the transmission line setting can also be changed by only performing the processing of converting the transmission format setting from one of "MST" and "SST" into the other. Therefore, it is possible to save the trouble of separately changing both the transmission format setting and the transmission line setting as practiced conventionally, and change the USB Type-C transmission line setting and transmission format setting by an easy operation to achieve the setting of the optimum transmission line state.

That is to say, in the case where the image transmission device supplies a single image (when the DisplayPort signal transmission format is set to "SST"), the other two differential signal lines out of the four differential signal lines can be used as USB 3.1 by setting the transmission line setting to Pin Assignment D.

Note that information related to the information being transmitted may be destroyed in some cases if the transmission line of USB 3.1 is cut while information transmission is performed using USB 3.1. Therefore, when changing from the transmission line setting which allows use of USB 3.1 to the transmission line setting which does not allow use of USB 3.1, it is preferable to display, before changing the setting, whether or not information communication is being performed using USB 3.1 by means of the video display unit 107, to confirm with (to call attention of) the user.

Moreover, the present exemplary embodiment has been described as an image display device which transmits an image to another daisy-connected image display device using an image output terminal. However the embodiment is not limited to this. For example, it is not necessary to connect another image display device or output an image to the image output terminal. Also, the image output terminal need not be provided. For example, in image display devices, the transmission line setting and the transmission format setting can be changed easily also in those cases where the image display devices are set so as to be able to change between the state of displaying (using) one image and the state of each displaying (using) a plurality of images.

Moreover, in the present exemplary embodiment, a transmission format is used as prescribed setting information in the description. However, the embodiment is not limited to this. For example, a transmission line setting may be used as the prescribed setting information. In such a case, as the setting information, for example, whether or not to use USB 3.1 can be set as a transmission line setting. The transmission format is changed from "MST" to "SST" when the setting of USB 3.1 is changed from "not in use (Pin Assignment C)" to "in use (Pin Assignment D)". Moreover, the transmission format may be changed from "SST" to "MST" when the setting of USB 3.1 is changed from "in use" to "not in use".

Second Exemplary Embodiment

A configuration of an image display device of a second exemplary embodiment is similar to that of the first exemplary embodiment shown in FIG. 1. Hereunder, in the image display device of the second exemplary embodiment, only the operation which differs from that in the image display device of the first exemplary embodiment will be described.

The point in which the present exemplary embodiment differs from the first exemplary embodiment is such that a change having been made in the transmission format setting is detected using a Hot-Plug-Detect pin in the DisplayPort-Out terminal used for daisy-chain output, without the user performing this transmission format setting operation by operating a control button, which is generally equipped on an image display device or a remote controller of an external device.

That is to say, the DisplayPort control unit 104 measures the voltage of the Hot-Plug-Detect pin at the DisplayPort-Out terminal and determines whether the measured voltage is at a "H (high)" level or at a "L (low)" level. Here, when the measured voltage is at the "H" level, the DisplayPort control unit 104 determines that another image display device is daisy-chain connected to the DisplayPort output unit 105 as a subsequent stage thereof. On the other hand, when the measured voltage is at the "L" level, the DisplayPort control unit 104 determines that the other image display device is not daisy-chain connected to the DisplayPort output unit 105.

The timing at which the user would desire to switch the transmission format setting from "SST" to "MST" is considered to be when the user desires to use multiple screens of a multi-display configuration by means of "MST". Therefore, as shown in FIG. 2, when the second image display device 2 is daisy-chain connected to the image display device 1 as a subsequent stage thereof, the DisplayPort control unit 104 detects the voltage of the Hot-Plug-Detect pin of the DisplayPort output unit 105 as having changed from the "L" level to the "H" level. Then, the DisplayPort control unit 104 outputs to the setting control unit 108, the result of detecting the voltage of the Hot-Plug-Detect pin as having changed from the "L" level to the "H" level. As a result, as in the first exemplary embodiment, the setting control unit 108 changes the transmission format setting from "SST" to "MST" and changes the transmission line setting from Pin Assignment D to Pin Assignment C.

On the other hand, the DisplayPort control unit 104 detects the daisy-chain connection of the image display device 2 to the image display device 1 as having been cut, that is to say, it detects the other image display device on the subsequent stage thereof as having been removed, by detecting the voltage of the Hot-Plug-Detect pin as having changed from the "H" level to the "L" level. That is to say, the DisplayPort control unit 104 performs a hot-plug detection. Then the DisplayPort control unit 104 outputs to the setting control unit 108, the result of detecting the voltage of the Hot-Plug-Detect pin as having changed from the "H" level to the "L" level. As a result, as in the first exemplary embodiment, the setting control unit 108 changes the transmission format setting from "MST" to "SST" and changes the transmission line setting from Pin Assignment C to Pin Assignment D.

As described above, according to the second exemplary embodiment, the DisplayPort control unit 104 measures the voltage of the Hot-Plug-Detect pin of the DisplayPort output unit 105, determines whether to set the transmission format setting to "SST" or "MST" using the measured voltage, and outputs the determined setting change to the setting control unit 108. The setting control unit 108 then performs each of the transmission format setting and the transmission line setting in a manner similar to that of the first exemplary embodiment. As a result, the transmission format setting and the transmission line setting are each performed based on whether the user daisy-chain connects or disconnect the image display device 2 as a subsequent stage to or from the image display device 1, and the image display device can reduce the burden on the user in setting the transmission format and setting the transmission line, as compared with the first exemplary embodiment.

Figure 4:
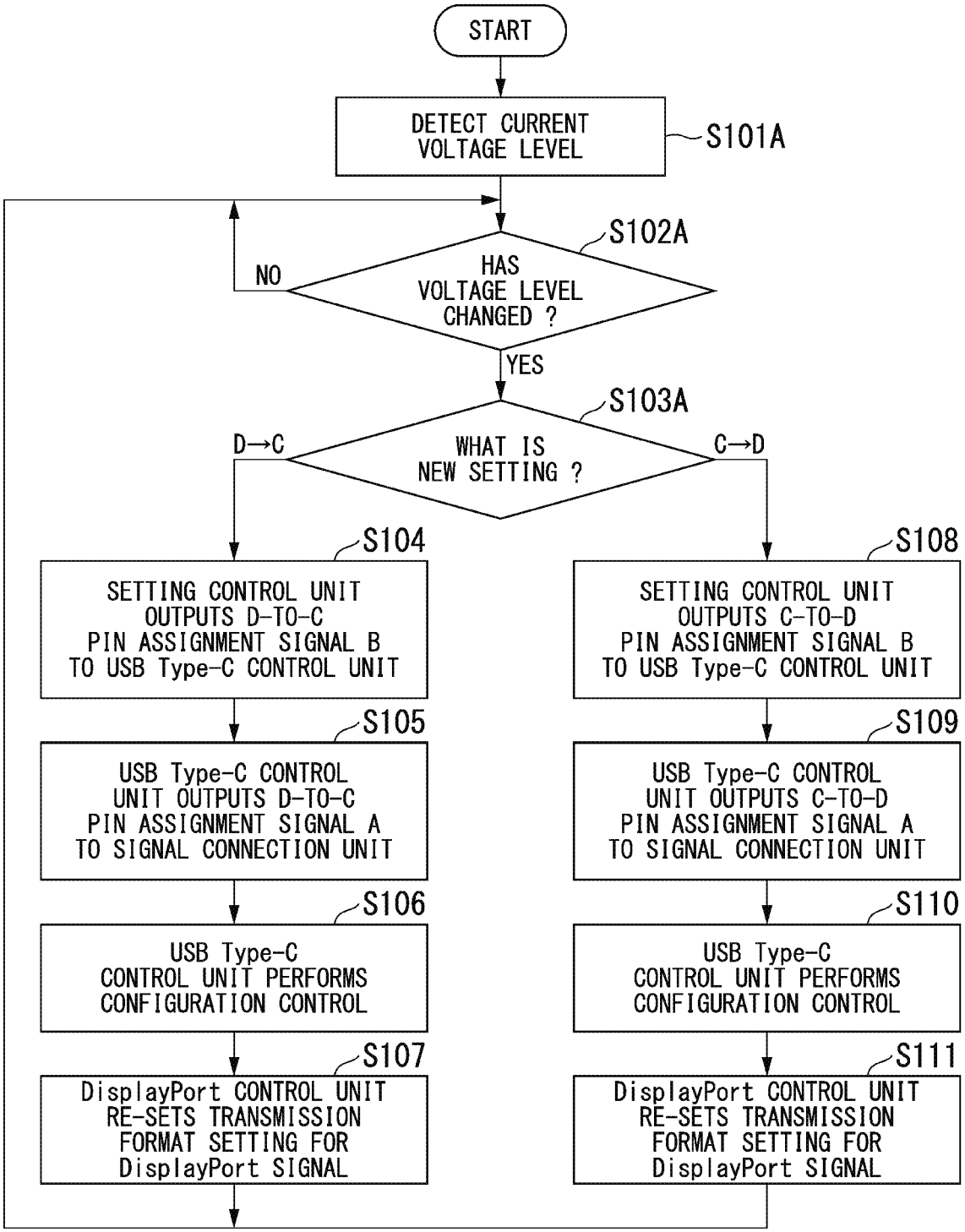
FIG. 4 is a flowchart showing an operation example showing control of transmission format setting and transmission line setting in the image display device 1 according to a second exemplary embodiment of the present invention.

FIG. 4 is a flowchart showing an operation example showing control of transmission format setting and transmission line setting in the image display device 1 according to the second exemplary embodiment of the present invention. Hereunder, each of Step S101A to Step S103A, which differ from those in the first exemplary embodiment, will be described, and descriptions of Step S104 to Step S111 will be omitted as these steps are similar to those in the processing of the first exemplary embodiment.

Step S101A: The DisplayPort control unit 104 measures the voltage of the Hot-Plug-Detect pin of the DisplayPort output unit 105 and determines whether the transmission format setting is "SST" or "MST", using the measured voltage.

Then if the measured voltage is at the "L" level, the DisplayPort control unit 104 determines that the transmission format setting is "SST". On the other hand, if the measured voltage is at the "H" level, it determines that the transmission format setting is "MST". The DisplayPort control unit 104 then writes and stores the determination result into the memory storage unit included therein.

Step S102A: The DisplayPort control unit 104 determines whether or not the voltage of the Hot-Plug-Detect pin of the DisplayPort output unit 105 has changed. At this time, if the voltage of the Hot-Plug-Detect pin has changed, the setting control unit 108 advances the process to Step S103A. On the other hand, if the voltage of the Hot-Plug-Detect pin has not changed, the setting control unit 108 repeats the process of Step S102A.

Step S103A: If the voltage of the Hot-Plug-Detect pin has changed from the "L" level to the "H" level, the DisplayPort control unit 104 outputs to the setting control unit 108, a control signal indicating that the transmission format setting has been changed from "SST" to "MST". Moreover, if the voltage of the Hot-Plug-Detect pin has changed from the "H" level to the "L" level, the DisplayPort control unit 104 outputs to the setting control unit 108, a control signal indicating that the transmission format setting has been changed from "MST" to "SST".

As a result, if the transmission format setting has been changed from "SST" to "MST", the setting control unit 108 advances the process to Step S104. On the other hand, if the transmission format setting has been changed from "MST" to "SST", the setting control unit 108 advances the process to Step S108.

The subsequent processing is similar to that in the first exemplary embodiment.

Third Exemplary Embodiment

A configuration of an image display device of a third exemplary embodiment is similar to that of the first exemplary embodiment shown in FIG. 1. Hereunder, in the image display device of the third exemplary embodiment, only the operation which differs from that in the image display device of the first exemplary embodiment will be described.

As with the first and second exemplary embodiments described above, in a case where the DisplayPort signal bandwidth always becomes insufficient when the second image display device is connected to the subsequent stage, the bandwidth issue can be solved by the configuration described in each of the first exemplary embodiment and the second exemplary embodiment. However, in the solutions of the first and second exemplary embodiments, the number of transmission lines for transmitting image signals increases when the transmission format setting is changed from "SST" to "MST". As a result, the transmission line having transmitted USB 3.1 signals therethrough is switched to the transmission line for DisplayPort signals. Therefore, USB 3.1 signal communication always switches to USB 2.0 signal communication. For this reason, from the user's point of view, there is a demerit in that data transmission speed in the USB decreases.

Therefore, in the case where the image transmission speed of DisplayPort signals required for each of the image display device 1 and the image display device 2 to perform display is a low speed such as 4 Gbps, or in the case where the bandwidth is not insufficient when using two screens due to an improved image transmission speed or a compressed image data amount, then in terms of convenience for the user, it is preferable that the transmission line setting continues with the Pin Assignment D setting rather than changing it to the Pin Assignment C setting.

For this reason, in the third exemplary embodiment, when the transmission format setting is set to "MST" and a plurality of other image display devices are daisy-chain connected to the image display device 1, the transmission line setting of the image display device 1 is changed according to the image transmission speed required for the image display devices on the subsequent stage thereof.

Figure 5:
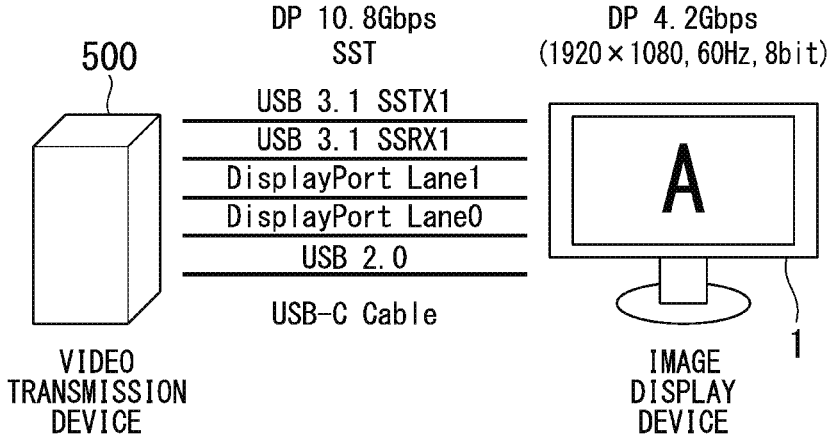
FIG. 5 is a diagram showing an example of a daisy-chain configuration of image display devices for describing a third exemplary embodiment.
Figure 6:
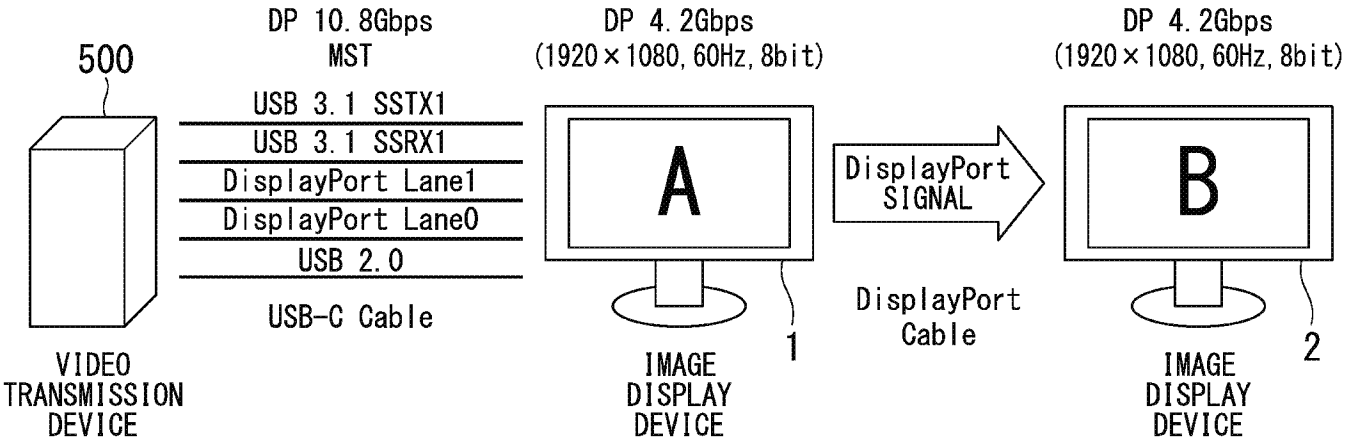
FIG. 6 is a diagram showing an example of a daisy-chain configuration of image display devices for describing the third exemplary embodiment.
Figure 7:
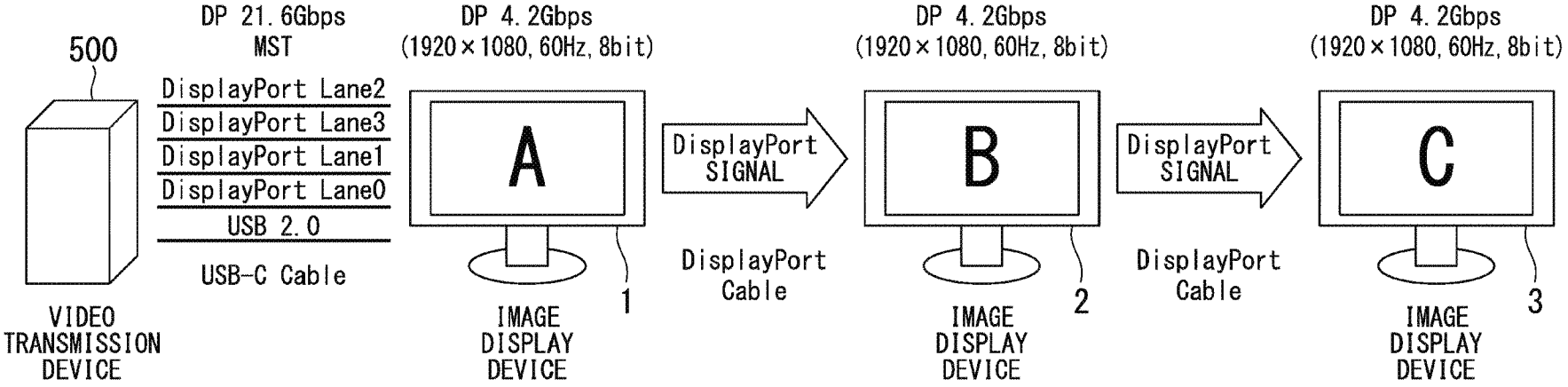
FIG. 7 is a diagram showing an example of a daisy-chain configuration of image display devices for describing the third exemplary embodiment.
Figure 8:
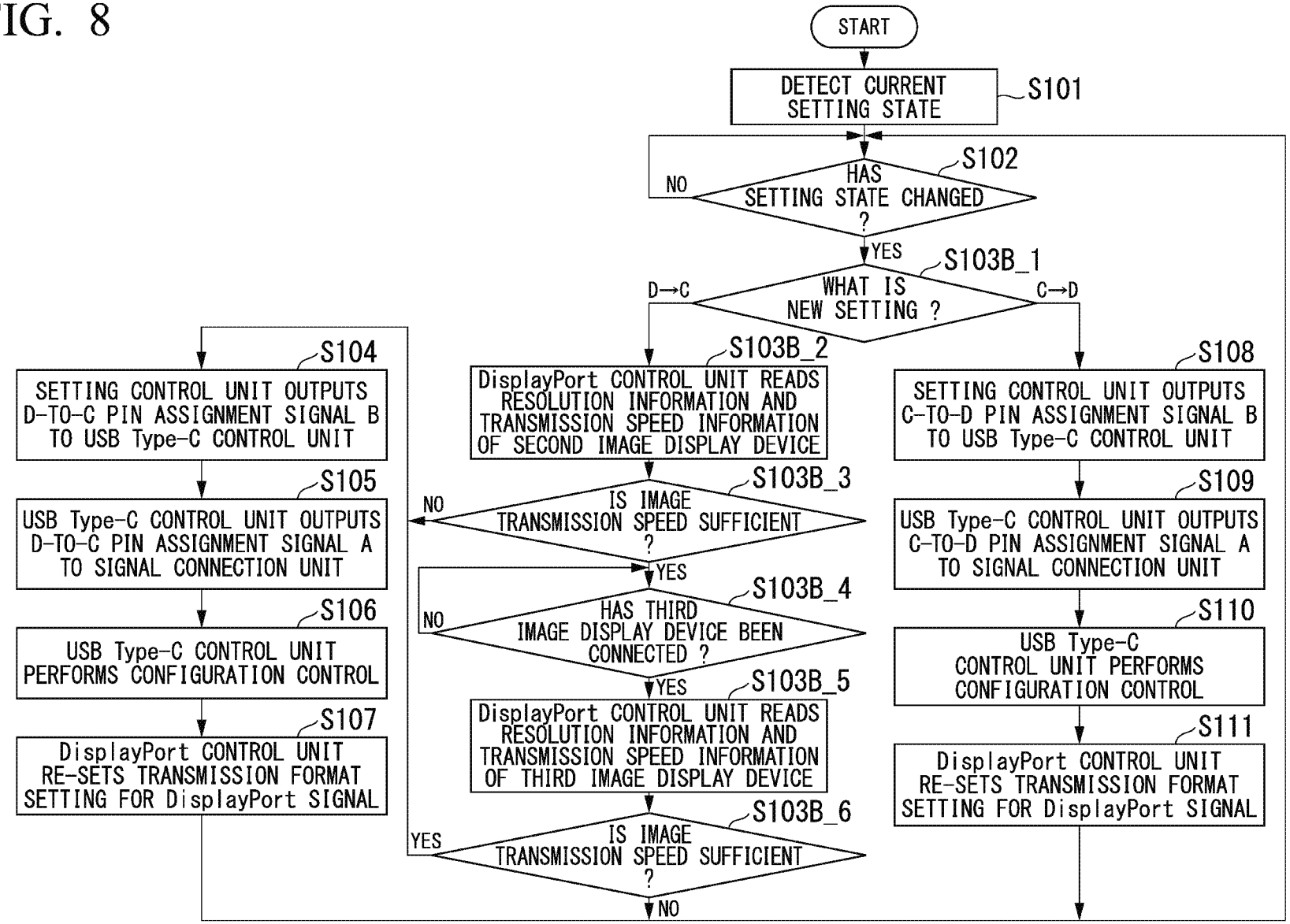
FIG. 8 is a flowchart showing an operation example showing control of transmission format setting and transmission line setting in the image display device 1 according to a third exemplary embodiment of the present invention.

For example, as shown in each of FIG. 6 to FIG. 8, the following description uses a case where the transmission format setting is set to "MST", and an image display device 2 and an image display device 3 are each daisy-chain connected to the image display device 1. FIG. 5, FIG. 6, and FIG. 7 are diagrams showing examples of daisy-chain settings of image display devices for describing the third exemplary embodiment.

FIG. 5 shows a case where the transmission format setting is set to "SST", and no other image display device is daisy-chain connected to the image display device 1. Accordingly, in the transmission line setting, two sets of the transmission lines (USB 3.1 SSTX1, USB 3.1 SSRX1) out of four sets of transmission lines are assigned to USB 3.1 signals, and two sets of transmission lines (DisplayPort Lane 0, DisplayPort Lane 1) are assigned to DisplayPort signals.

FIG. 6 shows a case where the image display device 2 is daisy-chain connected to the image display device 1 and the transmission format setting is set to "MST" while the image transmission speed of DisplayPort signals required for each of the image display device 1 and the image display device 2 to perform display is a low speed such as 4 Gbps. Accordingly, as with FIG. 5, in the transmission line setting, two sets of the transmission lines (USB 3.1 SSTX1, USB 3.1 SSRX1) out of the four sets of transmission lines are assigned to USB 3.1 signals, and two sets of transmission lines (DisplayPort Lane 0, DisplayPort Lane 1) are assigned to DisplayPort signals.

FIG. 7 shows a case where the image display device 2 and the image display device 3 are daisy-chain connected to the image display device 1 and the transmission format setting is set to "MST", while the image transmission speed of DisplayPort signals required for each of the image display device 1, the image display device 2, and the image display device 3 to perform display becomes insufficient with two sets of transmission lines. Accordingly, in the transmission line setting, all of the four sets of transmission lines (DisplayPort Lane 0 to DisplayPort Lane 3) are assigned to DisplayPort signals.

According to the third exemplary embodiment, in the image display device 1 to which an USB Type-C cable is connected, the DisplayPort control unit 104 calculates the video transmission speed required for the second image display device 2 and the third image display device 3 in the daisy-chain connection, based on resolution information included in EDID data and transmission speed information included in DPCD data which are transmitted through an AUX channel of the DisplayPort output unit 105.

In the third exemplary embodiment, only when the image transmission speed calculated by the DisplayPort control unit 104 is determined as not sufficient for the Pin Assignment D setting, is the setting switched to Pin Assignment C. As a result, according to the third exemplary embodiment, even in the case where the transmission format setting is set to "MST", optimum video display and USB 3.1 connection can be realized if the image transmission speed is sufficient, and only when the image transmission speed is determined as insufficient, the operation of switching to image display and USB 2.0 data communication is enabled, thereby reducing the reduction in the image transmission speed and improving the level of convenience for the user.

FIG. 8 is a flowchart showing an operation example showing control of transmission line setting and DisplayPort signal transmission format setting in the image display device 1 according to the third exemplary embodiment of the present invention. Hereunder, each of Step S103B_1 to Step S103B_6, which differ from those in the first exemplary embodiment, will be described, and descriptions of Step S101 and Step S102 as well as Step S104 to Step S111 will be omitted as these steps are similar to those in the processing of the first exemplary embodiment.

Step S103B_1: If the transmission format setting has been changed from "SST" to "MST", the image display device control unit 108 advances the process to Step S103B_1. On the other hand, if the transmission format setting has been changed from "MST" to "SST", the image display device control unit 108 advances the process to Step S108.

Step S103B_2: The DisplayPort control unit 104 reads resolution information included in EDID data and transmission speed information included in DPCD data, which are transmitted through the AUX channel of the DisplayPort output unit 105. The DisplayPort control unit 104 then obtains the image transmission speed required for the second image display device 2 in the daisy-chain connection, using the resolution information included in the EDID data and the transmission speed information included in the DPCD data, which have already been read.

Step S103B_3: The DisplayPort control unit 104 assigns two sets of transmission lines (DisplayPort Lane 0, DisplayPort Lane 1) out of the four sets of transmission lines to DisplayPort signals to thereby determine whether the transmission speed is sufficient with respect to the obtained image transmission speed. At this time, if the transmission speed is sufficient with respect to the obtained image transmission speed as a result of assigning two sets of transmission lines out of the four sets of transmission lines to DisplayPort signals, the DisplayPort control unit 104 advances the process to Step S103B_4. On the other hand, if the transmission speed is not sufficient with respect to the obtained image transmission speed as a result of assigning two sets out of the four sets of transmission lines to DisplayPort signals, the DisplayPort control unit 104 advances the process to Step S104.

The above exemplary embodiments have each been described, using the mode based on the DisplayPort Alt Mode on USB Type-C standard, however, the embodiments are not limited to this. For example, the embodiments can be applied to a mode in which a first signal and a second signal are transmitted using a signal cable having a plurality of transmission lines. It is desirable that the plurality of transmission lines have the same transmission characteristics.

Figure 9:
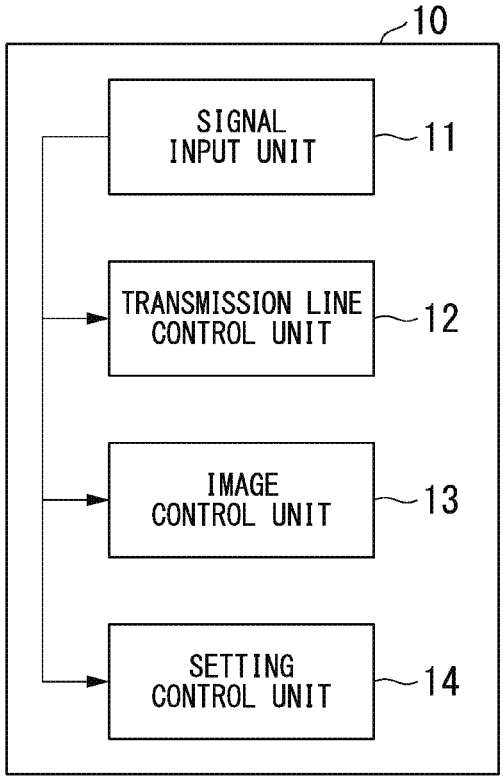
FIG. 9 is a diagram for describing a concept of the exemplary embodiments of the present invention.

FIG. 9 is a diagram for describing a concept of the exemplary embodiments of the present invention. In FIG. 9, an image display device 10 according to the exemplary embodiments of the present invention includes each of a signal input unit 11 (USB Type-C input unit 101), a transmission line control unit 12 (DisplayPort control unit 104), an image control unit 13 (DisplayPort control unit 104), and a setting control unit 14 (setting control unit 108).

In the signal input unit 11, a first signal (a DisplayPort signal) or a second signal (a USB signal supporting the USB standard) is supplied from an external device (not shown in the drawings), using a signal cable having a plurality of transmission lines of prescribed transmission characteristics.

The transmission line control unit 12 changes the destination to which a signal is supplied using the plurality of transmission lines, in accordance with a transmission line setting for setting at least a portion of the plurality of transmission lines as transmission lines which transmit the first signal.

The image control unit 13 generates an image signal from the first signal supplied using the transmission lines in accordance with a transmission format setting for designating a format for transmitting the first signal using the transmission lines set by the transmission line control unit 12.

The setting control unit 14 changes the transmission line setting and the transmission format setting in accordance with a change in prescribed setting information. That is to say, the transmission format setting for display port signals is set to either "SST" or "MST", and the transmission line setting in USB Type-C is switched to either Pin Assignment D or Pin Assignment C. After having changed the settings of the transmission line setting and the transmission format setting, the setting control unit 11 transmits a command for performing configuration, to the image display device.

As a result, in the transmission format setting of DisplayPort signals of the image display device on the first stage in the daisy-chain which forms a multi-display configuration, operations related to the processing of switching between "SST" and "MST" and the processing of setting USB Type-C Pin Assignment setting, that is, the processing of re-setting the transmission line setting can be easily performed, and the burden on the user can be reduced.

Moreover, in the transmission format setting of DisplayPort signals of the image display device in the multi-display configuration in FIG. 1, the operations related to switching the setting from "SST" to "MST" and setting USB Type-C Pin Assignment, that is, re-setting the transmission line setting may be performed by performing control which realizes the control function in the image display device, using an external computer system. The "computer system" mentioned here includes an operating system and hardware such as peripheral devices.

The exemplary embodiments of the present invention have been described in detail with reference to the drawings. However, the specific configuration is not limited to these exemplary embodiments and includes a design and so forth not departing from the gist of the present invention.

INDUSTRIAL APPLICABILITY

The image display device and the image display method described above make it easy to perform the processing related to the operation of switching setting between "SST" and "MST" in the transmission format setting of DisplayPort signals in an image display device (such as a liquid crystal display and a projector) on the first stage in a multi-display configuration formed by daisy-chain connected image display devices, and the operation of re-setting the USB Type-C transmission line setting, effectively realizing a reduction in the burden on the user.

REFERENCE SIGNS LIST

1, 10 Image display device
11 Signal input unit
12 Transmission line control unit
13 Image control unit
14, 108 Setting control unit
101 USB Type-C input unit
102 USB Type-C control unit
103 Signal connection unit

104 DisplayPort control unit
105 DisplayPort output unit
106 Video processing unit
107 Video display unit
109 USB 3.1 input unit
110 USB 2.0 input unit
111 USB hub
200 USB device
500 Image transmission device

The invention claimed is:

1. An image display device, comprising:

a signal input unit to which a first signal or a second signal is supplied, using a signal cable having a plurality of transmission lines of prescribed transmission characteristics;

a transmission line control unit configured to change a destination to which a signal is supplied using the plurality of transmission lines, in accordance with a transmission line setting for setting at least a portion of the plurality of transmission lines as transmission lines which transmit the first signal;

an image control unit configured to generate an image signal from the first signal supplied using the transmission lines in accordance with a transmission format setting for designating a format for transmitting the first signal using the transmission lines; and a setting control unit configured to change the transmission line setting and the transmission format setting in accordance with a change in prescribed setting information, wherein the prescribed setting information, the transmission line setting, and the transmission format setting are associated with each other on a one-to-one basis, and wherein the setting control unit is configured to, in case that the prescribed setting information is changed to other prescribed setting information:

change the transmission line setting of the transmission line control unit to other transmission line setting corresponding to the other prescribed settig information changed; and change the transmission format setting of the image control unit to other transmission format setting corresponding to the other prescribed setting information changed.

2. The image display device according to claim 1, wherein, after the setting control unit has changed at least display information including the transmission line setting and the transmission format setting, the setting control unit causes, via the signal cable connected to the signal input unit, an image transmission device supplying the first signal, to acquire the display information that has been changed.

3. The image display device according to claim 1, wherein, after the setting control unit has changed display information including at least the transmission line setting and the transmission format setting, the setting control unit causes, via the signal cable connected to the signal input unit, the image transmission device supplying the first signal, to execute a configuration.

4. The image display device according to claim 1, wherein the transmission line setting comprises a setting as to which transmission line among the plurality of transmission lines to use to transmit the first signal.

5. The image display device according to claim 1, wherein the transmission line setting comprises a setting which includes a number of transmission lines for transmitting the first signal or a number of transmission lines for transmitting signals other than the first signal, among the plurality of transmission lines.

6. The image display device according to claim 5, wherein the setting information comprises information of the transmission format setting.

7. The image display device according to claim 5, wherein the setting information comprises information of the transmission line setting.

8. The image display device according to claim 5, wherein the setting information comprises a voltage level of a Hot-Plug-Detect pin in a DisplayPort-Out terminal.

9. The image display device according to claim 5, wherein the transmission format setting includes a setting for transmitting one type of image, or a setting for transmitting a plurality of different images, wherein the transmission line setting includes a first image transmission line setting for supplying the first signal using a portion of the plurality of transmission lines, or a second image transmission line setting for supplying the first signal using all of the plurality of transmission lines, wherein a first association which associates the setting for transmitting the one type of image with the first image transmission line setting, and a second association which associates the setting for transmitting the plurality of different images with the second image transmission line setting, are predetermined, wherein the setting control unit is configured to, in case that the prescribed setting information is changed to information indicating the first association:

change the transmission line setting of the transmission line control unit to the first image transmission line setting corresponding to the first association; and change the transmission format setting of the image control unit to the setting for transmitting the one type of image corresponding to the first association, and wherein the setting control unit is configured to, in case that the prescribed setting information is changed to information indicating the second association:

change the transmission line setting of the transmission line control unit to the second image transmission line setting corresponding to the second association; and change the transmission format setting of the image control unit to the setting for transmitting the plurality of different images, corresponding to the second association.

10. The image display device according to claim 9, wherein, in case that the prescribed setting information is changed from information indicating the first association to information indicating the second association, and in case that an image transmission speed which includes a speed for transmitting an image calculated, by the image control unit, based on resolution information and transmission speed information in the first signal is enough for the first image transmission line setting set in the transmission line control unit, regardless of the second association, the setting control unit is configured to keep the transmission line setting of the transmission line control unit at the first image transmission line setting, and change the transmission format setting of the image control unit to the setting for transmitting the plurality of different images.

11. The image display device according to claim 9, wherein the setting for transmitting the one type of image of the transmission format setting includes a single stream setting in an interface standard for transmitting a signal of a display port, and wherein the setting for transmitting the plurality of different images includes a multi-stream setting in the interface standard for transmitting the signal of the display port.

12. The image display device according to claim 9, wherein the first image transmission line setting includes a setting of a transmission line corresponding to Pin Assignment D in a standard of USB, and wherein the second image transmission line setting includes a setting of a transmission line corresponding to Pin Assignment C in the standard of USB.

13. The image display device according to claim 9, wherein the transmission format setting includes the setting for transmitting the one type of image.

14. An image display method, comprising:

receiving a first signal or a second signal, using a signal cable having a plurality of transmission lines of prescribed transmission characteristics;

changing a destination to which a signal is supplied using the plurality of transmission lines, in accordance with a transmission line setting for setting at least a portion of the plurality of transmission lines as transmission lines which transmit the first signal;

generating an image signal from the first signal supplied using the transmission lines, in accordance with a transmission format setting for designating a format for transmitting the first signal using the transmission lines; and changing the transmission line setting and the transmission format setting, in accordance with a change in prescribed setting information, wherein the prescribed setting information, the transmission line setting, and the transmission format setting are associated with each other on a one-to-one basis, and wherein, in the changing of the transmission line setting and the transmission format setting, in case that the prescribed setting information is changed to other prescribed setting information:

the transmission line setting in the change of the destination is chanced to other transmission line setting corresponding, to the other prescribed setting information changed; and the transmission format setting in the generation of the image signal is changed to other transmission format setting corresponding to the other prescribed setting in formation changed.

* * * * *